US005666927A

United States Patent [19]

Pace et al.

[11] Patent Number: 5,666,927

[45] Date of Patent: Sep. 16, 1997

[54] FUEL/AIR SUPPLY SYSTEM FOR A FUEL INJECTOR AND METHODS OF OPERATION

[75] Inventors: Jeffrey B. Pace, Newport News; Vernon R. Warner, Wicomico, both of Va.

[73] Assignee: Siemens Automotive Corporation, Auburn Hills, Mich.

[21] Appl. No.: 686,937

[22] Filed: Jul. 26, 1996

[51] Int. Cl.[6] ..... F02M 23/00

[52] U.S. Cl. ..... 123/533; 123/457

[58] Field of Search ..... 123/533, 531, 123/522, 457, 514, 447

[56] References Cited

U.S. PATENT DOCUMENTS

| | | | |
|---|---|---|---|
| 3,790,139 | 2/1974 | Stephenson | 123/522 |
| 4,220,127 | 9/1980 | Reynolds | 123/522 |
| 4,387,695 | 6/1983 | Höppel et al. . | |
| 4,404,947 | 9/1983 | Swanson . | |
| 4,543,939 | 10/1985 | Ehrhart | 123/531 |
| 4,545,354 | 10/1985 | Jaggle et al. . | |
| 4,690,118 | 9/1987 | Hofbauer | 123/533 |
| 4,754,740 | 7/1988 | Emmenthal | 123/533 |
| 4,794,901 | 1/1989 | Hong | 123/533 |
| 4,841,942 | 6/1989 | McKay | 123/533 |
| 5,054,453 | 10/1991 | Onufer | 123/522 |
| 5,088,467 | 2/1992 | Mesenich | 123/531 |
| 5,156,133 | 10/1992 | Sugimoto | 123/533 |
| 5,241,938 | 9/1993 | Takagi et al. . | |
| 5,245,974 | 9/1993 | Watson | 123/533 |
| 5,355,858 | 10/1994 | Kiyomura et al. . | |
| 5,385,133 | 1/1995 | Ikuta et al. . | |
| 5,392,746 | 2/1995 | Pontoppidan . | |

*Primary Examiner*—Carl S. Miller
*Attorney, Agent, or Firm*—Russel C. Wells

[57] ABSTRACT

The fuel and air supply system of the present invention provides fuel from a fuel pump at a first pressure upstream of a pressure reducer, fuel being provided directly to the fuel injector at a reduced pressure on the downstream side of the pressure reducer. A bypass line in communication with the fuel line upstream of the pressure reducer provides fuel to an air reservoir at the first pressure. The air reservoir lies in communication with a porous member(s) in the fuel injector in an air inlet to a fuel volume within the injector upstream of the pressure reducer. Upon flow of fuel into the air reservoir and closure of normally open fuel and air valves in the reservoir, air at the first pressure is supplied the porous member(s), creating a pressure differential across the member(s), causing air to flow through the porous member (s) to form air bubbles in the fuel volume for two-phase flow through the fuel injector orifice. The air flows for a predetermined time until the reservoir fills with fuel which precludes further air flow into the injector. Upon shutdown of the engine, the valves in the air reservoir open, draining the fuel from the air reservoir and enabling air at atmospheric pressure to enter the reservoir, returning the system for reuse upon engine startup.

14 Claims, 2 Drawing Sheets

FUEL/AIR SUPPLY SYSTEM FOR A FUEL INJECTOR AND METHODS OF OPERATION

TECHNICAL FIELD

The present invention relates generally to a fuel and air supply system for fuel injectors and particularly relates to a system for supplying fuel and air to a fuel injector over a predetermined time interval whereby a fuel/air dispersion can be effected through the orifice of the fuel injector, e.g., at engine start-up, and to methods of operating the fuel/air supply system.

BACKGROUND

Fuel injectors typically comprise an electromagnetically actuated needle valve disposed in a fuel volume and which needle valve is reciprocated axially within the fuel volume in response to energization and deenergization of an actuator to selectively open and close a flow path through the fuel injector. Particularly, the valve body or housing defining the fuel volume has an aperture or orifice at one end about which is formed a seat for the end of the needle valve whereby reciprocating motion of the needle valve enables an intermittent flow of fuel through the orifice. Fuel emitted from a fuel injector is typically atomized downstream of the orifice to provide the necessary fuel/air mixture in the combustion chamber of the engine.

In a companion application by the present inventors U.S. Ser. No. 08/686,959 filed Jul. 26, 1996 and entitled Fuel Injector With Air Bubble/Fuel Dispersion Prior to Injection and Methods of Operation, there is provided a fuel injector in which an air bubble/fuel dispersion is provided within the fuel volume of a fuel injector upstream of the injector orifice. This is accomplished by supplying air under pressure through one or more porous members situate in an air inlet in communication with the fuel volume upstream of the orifice. The air flows through the porous member and forms bubbles of a predetermined size in the fuel within the fuel volume. The bubbles are sized by the pore size of the porous member such that the air bubbles dispersed in the fuel in the fuel volume do not substantially rise. Consequently, a predetermined mass of a two-phase air bubble/fuel dispersion can be ejected through the orifice of the fuel injector for improved atomization, fuel economy and burn with resulting lower emissions. The present invention provides novel and improved apparatus and methods for supplying fuel and air to a fuel injector of that type and over a predetermined time interval.

DISCLOSURE OF THE INVENTION

In accordance with the present invention, fuel is supplied from a fuel pump at a first or line pressure and through a pressure reducing element, e.g., for supplying fuel at a reduced or lower pressure directly to the fuel injector. Upstream of the pressure reducing element, a bypass line is coupled between the fuel supply line and an air reservoir. Fuel is thus supplied from the fuel pump into the air reservoir and at the first pressure. The air reservoir is in turn in communication with the air inlet of the fuel injector. Air is therefore supplied from the air reservoir at the line or first pressure to the air inlet and through the porous member to form the air bubbles in the fuel in the fuel volume of the injector at a location upstream of the orifice. The air reservoir includes an air valve normally open to the atmosphere or another air source and which air valve can be mechanically or electrically operated to close, e.g., upon pressurization of the air reservoir. The air reservoir also has a normally open fuel valve which is likewise operated, e.g., to close in response to pressurization of the air reservoir. The fuel valve lies in communication with a fuel tank which, of course, supplies fuel to the fuel pump.

To operate the fuel/air supply system for the fuel injector, for example, upon engine start-up, fuel at the first pressure is supplied to the air reservoir, pressurizing the air in the reservoir. The air and fuel valves in the air reservoir, when pressurized, are closed. Fuel is also supplied through the pressure reducing element directly to the fuel inlet for the fuel injector at a lower pressure than the first pressure. As a consequence, air in the air reservoir attains the fuel supply line pressure, i.e., the first pressure, and establishes a pressure difference across the porous member or members in the fuel injector. This pressure difference causes the air to pass through the porous member into the fuel in the fuel volume in the form of small discrete bubbles 40 microns or less in size to form the air bubble/fuel dispersion. This dispersion is intermittently injected into the combustion engine by periodic operation of the needle valve opening and closing the fuel injector orifice.

It will be appreciated that the air reservoir will eventually fill with fuel including the air line to the porous member(s) of the fuel injector. However, because the porous member(s) are substantially impermeable to fuel, fuel from the air reservoir when filled will not pass through the porous member. When the fuel pump is deenergized, for example, when the engine is turned off, both the fuel valve connecting the air reservoir to the fuel tank and the air valve between the air reservoir and atmosphere or another source of air are opened. This may be accomplished electrically in response to engine shutdown or mechanically in response to atmospheric or another pressure in the air reservoir. By opening the valves, air at reduced pressure is supplied to the air reservoir and the fuel in the air reservoir flows to the fuel tank of the engine, effectively emptying the air reservoir.

Given a particular size of air reservoir and a given pressure difference across the pressure reducer, it will be appreciated that air will be supplied to the air inlet of the injector for a predetermined period of time, after which air will no longer be supplied to the fuel injector. At that time and thereafter, only fuel will pass through the orifice of the injector in a conventional manner. Consequently, the system is particularly effective at engine start-up to provide improved atomization of the fuel to the engine with subsequent conventional operation of the injector. The system is also self-regulating by returning the air reservoir to its normal condition substantially void of fuel. Thus, the engine can be restarted with the air reservoir supplying air to the fuel injector, again enabling an air bubble/fuel dispersion to be injected through the orifice of the injector into the engine upon start-up.

In a preferred embodiment according to the present invention, there is provided a system for supplying a two-phase air/fuel dispersion to an engine comprising a fuel injector having an orifice, a fuel volume upstream of the orifice for containing fuel, a valve for opening and closing the orifice, and an air inlet to the fuel volume having a member for admitting air into the fuel volume to cause the formation of air bubbles in the fuel in the fuel volume; a fuel supply line connected to the fuel injector for supplying fuel to the fuel volume; a pressure reducer in the fuel supply line upstream of the fuel volume for supplying fuel to the fuel volume at a pressure lower than a fuel supply line pressure upstream of the pressure reducer; an air reservoir in communication with the air inlet for supplying air to the inlet at a pressure higher than the pressure of the fuel supplied to the fuel volume and a bypass line coupled between the air reservoir and the fuel supply line at a location upstream of the pressure reducer for supplying fuel to the air reservoir at a pressure corresponding to the supply line pressure upstream of the pressure reducer, thereby enabling flow of air to the air inlet at a higher pressure than the pressure of the fuel in the fuel volume and the formation of an air/bubble fuel dispersion in the fuel volume upstream of the fuel injector orifice.

In a further preferred embodiment according to the present invention, there is provided a system for supplying a two-phase air/fuel dispersion to an engine comprising a fuel delivery device having a fuel volume and an air inlet to the fuel volume having a member for admitting air into the fuel volume to cause the formation of air bubbles in the fuel in the fuel volume, a fuel supply line connected to the fuel delivery device for supplying fuel to the fuel volume, a pressure reducer in the fuel supply line upstream of the fuel volume for supplying fuel to the fuel volume at a pressure lower than a fuel supply line pressure upstream of the pressure reducer, an air reservoir in communication with the air inlet for supplying air to the inlet at a pressure higher than the pressure of the fuel supplied to the fuel volume, a bypass line coupled between the air reservoir and the fuel supply line at a location upstream of the pressure reducer for supplying fuel to the air reservoir at a pressure corresponding to the supply line pressure upstream of the pressure reducer, thereby enabling flow of air to the air inlet at a higher pressure than the pressure of the fuel in the fuel volume and the formation of an air bubble/fuel dispersion in the fuel volume.

In a still further preferred embodiment according to the present invention, there is provided, in a fuel injection system for a combustion engine having an injector, an orifice in the fuel injector, a fuel volume upstream of the orifice for containing fuel, an air inlet to the fuel volume having a member therein admitting air into the volume causing the formation of air bubbles in the fuel in the fuel volume, and a valve for opening and closing the orifice to flow an air bubble/fuel dispersion through the orifice when the valve is opened, a method of supplying fuel and air to the injector, comprising the steps of flowing fuel to an air reservoir at a first pressure to pressurize air in the reservoir, flowing fuel to the fuel volume of the injector at a second pressure less than the first pressure and flowing the pressurized air from the air reservoir to the air inlet at a pressure substantially corresponding to the first pressure thereby establishing a pressure differential across the member and flow of air through the member into the fuel volume.

Accordingly, it is a primary object of the present invention to provide a novel and improved air and fuel supply system for a fuel injector having improved atomization characteristics and methods of operating the system.

BEST MODE FOR CARRYING OUT THE INVENTION

Figure 1:
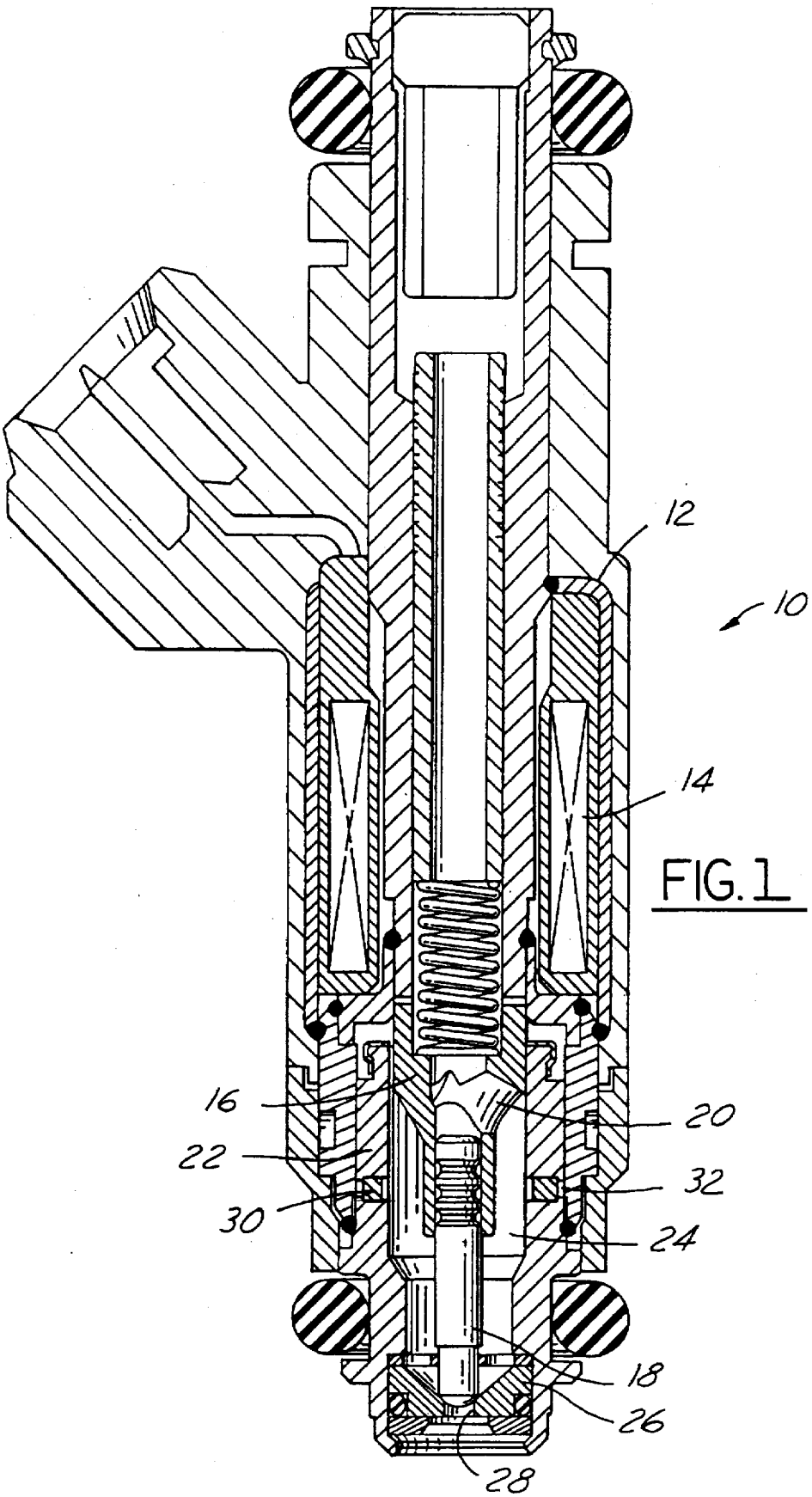
FIG. 1 is a longitudinal cross-sectional view of a fuel injector for use with a fuel/air supply system constructed in accordance with the present invention.

Referring now to FIG. 1, there is illustrated a fuel injector constructed in accordance with our invention as set forth in companion patent application Ser. No. 08/686,939, filed Jul. 26, 1996, of common assignee, the subject matter of which is incorporated herein by reference. In accordance with that invention, there is provided a fuel injector, generally designated 10, including a housing assembly 12 mounting a coil assembly 14 and an armature 16 coupled to a needle valve 18. Surrounding the needle valve 18 is a housing 22 defining a fuel volume 24 in communication with a fuel flow passage 20 through the armature. At the lower end of housing 22 is a valve seat 26 defining an orifice 28 through which an air bubble/fuel dispersion is ejected from the fuel injector into the engine as set forth in the previously described companion application. It will be appreciated that the coil 14 and armature 16 cooperate to open and close orifice 28 by periodic axial movement of needle valve 18 within fuel volume 24.

In accordance with the invention of that companion application, one or more porous members 30 are provided in an air inlet 32 in communication with the fuel volume 24. By providing air at a higher pressure than the pressure of the fuel in fuel volume 24, and a pore size in the porous member sufficiently small, e.g., 40 microns or less, air bubbles are provided in the fuel in the fuel volume of a size which do not substantially rise within the fuel volume. In this manner, a constant known mass of fuel can be injected into the engine upon opening the orifice 28 by actuation of the needle valve 18.

Figure 2:
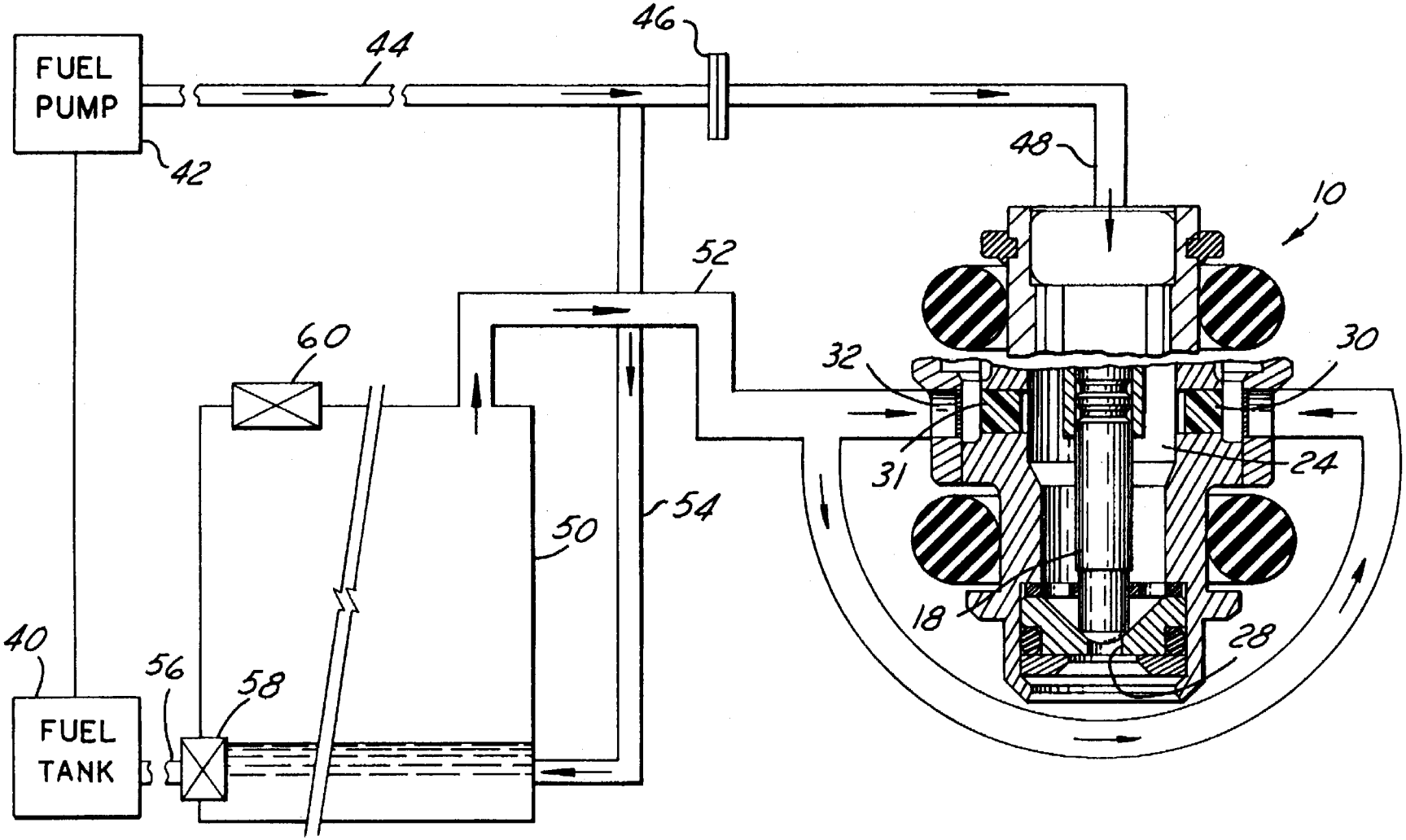
FIG. 2 is a schematic diagram of the fuel/air supply system hereof for supplying fuel and air to the fuel injector illustrated in FIG. 1.

Referring now to FIG. 2, a fuel and air supply system according to the present invention is illustrated. Particularly, there is provided a fuel tank 40 in communication with a fuel pump 42 for supplying fuel under a first pressure to a fuel supply line 44. A pressure reducing element 46, e.g., a restrictor or pressure regulator, is disposed in the fuel supply line 44 for supplying fuel directly to the fuel injector 10 at a second reduced pressure, for example, through a fuel feed line 48, for flow into the fuel volume 24 via passage 20.

An air reservoir 50 is also provided and lies in communication via a line 52 with the air inlet 32 of injector 10. The air inlet 32 may comprise an annular manifold about the injector in communication with one or more ports 31 opening into fuel volume 24. Air line 52 supplies air to the air inlet 32 of the injector at a pressure higher than the pressure of the fuel supplied to the fuel volume 24 via feed line 48. To accomplish this, a fuel bypass line 54 communicates between fuel supply line 44 and reservoir 50. From a review of drawing FIG. 2, it will be appreciated that the bypass line 54 communicates with the fuel supply line 44 upstream of the pressure reducing element 46. Consequently, fuel is supplied at the first pressure to the air reservoir 50, while fuel is supplied to the fuel injector and fuel volume 24 at a reduced pressure via line 48. Air reservoir 50 is provided with a fuel return line 56 for returning fuel supplied to air reservoir 50 from the fuel supply line 44 and bypass line 54 to the fuel tank 40. A first normally open fuel valve 58, which may be mechanically or electrically operated, e.g., in response to a predetermined pressure in the air reservoir or engine start-up, is provided. A second, normally open air valve 60 is provided, preferably adjacent the upper end of air reservoir 50. Valve 60 may similarly be mechanically or electrically operated to close in response to a pressure within the air reservoir 50 in excess of the predetermined air pressure or to engine start-up. Both valves return to their normally open positions when the system is not in use, e.g., in response to depressurization of the air reservoir or engine shutdown.

To operate the fuel and air supply system hereof, the air reservoir, with the engine off, contains a predetermined air pressure, for example, and preferably atmospheric pressure, with valves 58 and 60 open. Fuel valve 58 is normally open such that any fuel in the air reservoir drains to the fuel tank 40, and air valve 60 is normally open, preferably such that the air reservoir is at atmospheric pressure. At start-up, fuel pump 42 supplies fuel from the fuel tank 40 under pressure via supply line 44 to both the fuel injector and the air reservoir. The fuel supplied to the fuel injector is at a pressure reduced from or lower than the pressure of the fuel in supply line 44. Fuel is also supplied via line 54 to the air reservoir at a pressure corresponding to the pressure of fuel supply line 44 thereby increasing the air pressure within the air reservoir 50. This increase in air pressure may close the normally open valves 58 and 60 or they may be electrically actuated to close in response to engine start-up, e.g., energization of the fuel pump. Thus, the air pressure in air reservoir 50 corresponds to the pressure of the fuel supplied to the air reservoir 50 from fuel supply line 44. It will be appreciated that the air supplied to the air inlet 32 of the injector via the air reservoir 50 and air supply line 52 will therefore be at a higher pressure than the pressure of the fuel in fuel volume 24. Air will therefore pass through the porous member into the fuel volume, creating a two-phase air bubble/fuel dispersion in the fuel. Consequently, the dispersion flows through the orifice 28 upon opening valve 18.

Upon starting the engine, it will be appreciated that fuel continues to flow via the bypass line 54 into the air reservoir until such time as the reservoir and air line 52 are filled with fuel under the first pressure. When the fuel reaches the porous member(s), the air reservoir 50 and line 52 are completely filled with fuel and air is no longer supplied to the fuel volume. The fuel injector thereafter operates in a normal manner, i.e., fuel is sprayed through the orifice for downstream atomization and ingress into the engine without prior atomization in the fuel volume.

When the engine is shut off, the fuel pump 42 discontinues pressurizing the fuel in line 44. The air reservoir is thus depressurized and the valves 58 and 60 open to permit outflow of fuel from air reservoir 50 into the fuel tank 40 and inflow of air at a predetermined pressure, respectively, into the air reservoir. Consequently, the air reservoir is substantially emptied of fuel, and replaced by air at a predetermined, preferably atmospheric, pressure. Upon restarting the engine, the cycle is repeated, whereby the air bubble/fuel dispersion is provided in the fuel volume of the injector for ejection through the orifice 28 only for a predetermined time until the reservoir 50 and line 52 fill with fuel. At that time, atomization of the fuel prior to injection through the orifice 18 is discontinued while fuel continues to be injected through orifice 18.

As a specific example of the operation of the system, the pressure reducing element 46 may provide a 10% pressure drop in the fuel flow. Consequently, if fuel is supplied via line 44 at 300 kPa, the fuel is supplied to the fuel injector at 270 kPa, while fuel is provided the air reservoir 50 at 300 kPa. Consequently, a 30 kPa pressure differential appears across the porous member(s). This pressure difference and consequent air flow from the air reservoir through the porous member(s) will continue for a period of time, controlled by the pressure difference and the volume of air in the reservoir. Once the air is displaced, the fuel filling the air reservoir and line 52 precludes further injection of air into the fuel volume.

While the fuel and air supply system hereof is preferably for use with a fuel injector, it will be appreciated that the system may be provided for use with other types of fuel delivery devices. For example, one such device may include a carburetor system having a fuel reservoir or float chamber supplied with an air bubble/fuel dispersion for subsequent mixing with a charge of air for distribution to the cylinders of the engine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for supplying a two-phase air/fuel dispersion to an engine comprising:

a fuel injector having an orifice, a fuel volume upstream of said orifice for containing fuel, a valve for opening and closing said orifice, and an air inlet to said fuel volume having a member for admitting air into said fuel volume to cause the formation of air bubbles in the fuel in said fuel volume;

a fuel supply line connected to said fuel injector for supplying fuel to said fuel volume;

a pressure reducer in said fuel supply line upstream of said fuel volume for supplying fuel to said fuel volume at a pressure lower than a fuel supply line pressure upstream of said pressure reducer;

an air reservoir in communication with said air inlet for supplying air to said inlet at a pressure higher than the pressure of the fuel supplied to said fuel volume; and a bypass line coupled between said air reservoir and said fuel supply line at a location upstream of said pressure reducer for supplying fuel to said air reservoir at a pressure corresponding to the supply line pressure upstream of said pressure reducer, thereby enabling flow of air to said air inlet at a higher pressure than the pressure of the fuel in said fuel volume and the formation of an air bubble/fuel dispersion in said fuel volume upstream of the fuel injector orifice.

2. A system according to claim 1 including a fuel pump for supplying fuel to said fuel supply line and a fuel tank coupled to said air reservoir for receiving fuel from said reservoir.

3. A system according to claim 2 including a valve connected between said reservoir and said fuel tank, said valve being normally open and closing in response to pressurization of said reservoir upon flow of fuel through said bypass line into said reservoir.

4. A system according to claim 1 including a valve carried by said reservoir and normally open to the atmosphere, said valve being closed in response to pressurization of said reservoir upon flow of fuel through said bypass line into said reservoir.

5. A system according to claim 1 wherein said porous member includes a member permeable to air for flowing air into said volume and substantially impermeable to flow of fuel from said fuel volume through said member.

6. A system for supplying a two-phase air/fuel dispersion to an engine comprising:

a fuel delivery device having a fuel volume and an air inlet to said fuel volume having a member for admitting air into said fuel volume to cause the formation of air bubbles in the fuel in said fuel volume;

a fuel supply line connected to said fuel delivery device for supplying fuel to said fuel volume;

a pressure reducer in said fuel supply line upstream of said fuel volume for supplying fuel to said fuel volume at a pressure lower than a fuel supply line pressure upstream of said pressure reducer;

an air reservoir in communication with said air inlet for supplying air to said inlet at a pressure higher than the pressure of the fuel supplied to said fuel volume; and a bypass line coupled between said air reservoir and said fuel supply line at a location upstream of said pressure reducer for supplying fuel to said air reservoir at a pressure corresponding to the supply line pressure upstream of said pressure reducer, thereby enabling flow of air to said air inlet at a higher pressure than the pressure of the fuel in said fuel volume and the formation of an air bubble/fuel dispersion in said fuel volume.

7. A system according to claim 6 including a fuel pump for supplying fuel to said fuel supply line and a fuel tank coupled to said air reservoir for receiving fuel from said reservoir.

8. A system according to claim 7 including a valve connected between said reservoir and said fuel tank, said valve being normally open and closing in response to pressurization of said reservoir upon flow of fuel through said bypass line into said reservoir.

9. A system according to claim 6 including a valve carried by said reservoir and normally open to the atmosphere, said valve being closed in response to pressurization of said reservoir upon flow of fuel through said bypass line into said reservoir.

10. A system according to claim 6 wherein said porous member includes a member permeable to air for flowing air into said volume and substantially impermeable to flow of fuel from said fuel volume through said member.

11. In a fuel injection system for a combustion engine having an injector, an orifice in said fuel injector, a fuel volume upstream of said orifice for containing fuel, an air inlet to said fuel volume having a member therein admitting air into said volume causing the formation of air bubbles in the fuel in said fuel volume, and a valve for opening and closing the orifice to flow an air bubble/fuel dispersion through said orifice when said valve is opened, a method of supplying fuel and air to the injector, comprising the steps of:

flowing fuel to an air reservoir at a first pressure to pressurize air in said reservoir;

flowing fuel to said fuel volume of said fuel injector at a second pressure less than said first pressure; and flowing the pressurized air from said air reservoir to said air inlet at a pressure substantially corresponding to said first pressure thereby establishing a pressure differential across said member and flow of air through said member into said fuel volume.

12. A method according to claim 11 wherein said system includes a fuel pump and including the step of providing fuel at said first pressure from said fuel pump to said air reservoir, said air reservoir including a valve and further including the step of opening said valve to depressurize said air reservoir in response to deactuation of said fuel pump.

13. A method according to claim 12 wherein the system includes a fuel tank and including the step of flowing fuel from said air reservoir to said fuel tank in response to deactuation of said fuel pump.

14. A method according to claim 11 including providing air to said fuel injector for a predetermined time period during engine start-up, and thereafter, discontinuing flow of air to the fuel injector and continuing flow of fuel to the injector for flow through said orifice.

* * * * *